US012419365B2

(12) United States Patent
Bell-Counts

(10) Patent No.: US 12,419,365 B2
(45) Date of Patent: Sep. 23, 2025

(54) ADJUSTABLE BRASSIERE

(71) Applicant: SIT RITE LLC, Southfield, MI (US)

(72) Inventor: LaToya Bell-Counts, Southfiled, MI (US)

(73) Assignee: SIT RITE LLC, Southfield, MI (US)

( * ) Notice: Subject to any disclaimer, the term of this patent is extended or adjusted under 35 U.S.C. 154(b) by 0 days.

(21) Appl. No.: 18/419,236

(22) Filed: Jan. 22, 2024

(65) Prior Publication Data

US 2024/0245145 A1 Jul. 25, 2024

Related U.S. Application Data

(60) Provisional application No. 63/480,854, filed on Jan. 20, 2023.

(51) Int. Cl.
*A41C 3/00* (2006.01)
*A41C 3/12* (2006.01)

(52) U.S. Cl.
CPC ..... *A41C 3/0028* (2013.01); *A41C 3/128* (2013.01)

(58) Field of Classification Search
CPC ..... A41C 3/0028; A41C 3/128
USPC ..... 450/86
See application file for complete search history.

(56) References Cited

U.S. PATENT DOCUMENTS

| | | | | |
|---|---|---|---|---|
| 6,086,451 | A * | 7/2000 | Fernandes | A41F 15/002 450/86 |
| 6,733,362 | B2 * | 5/2004 | Plew | A41C 3/00 450/86 |
| 10,342,269 | B1 * | 7/2019 | Rutkoski | A41C 3/0057 |
| 11,178,918 | B1 * | 11/2021 | Ratcliff | A41C 3/12 |
| 11,758,959 | B2 * | 9/2023 | Mabon | A41C 3/0028 450/86 |
| 11,871,801 | B1 * | 1/2024 | Ratcliff | A44C 15/009 |
| 12,082,629 | B2 * | 9/2024 | Drynan | A41C 3/0078 |
| 2020/0054079 | A1 * | 2/2020 | Rutkoski | A41C 3/005 |
| 2021/0145098 | A1 * | 5/2021 | Mabon | A41F 15/002 |
| 2021/0392959 | A1 * | 12/2021 | Harp | A41C 3/0028 |

* cited by examiner

*Primary Examiner* — Gloria M Hale
(74) *Attorney, Agent, or Firm* — Foster, Swift, Collins & Smith, PC; Mikhail Murshak

(57) ABSTRACT

An adjustable brassiere undergarment having a first cup defining an upper edge and a second cup defining an upper edge. A first wing extends laterally away from the first cup and a second wing extends laterally away from the second cup. The first wing defines a peripheral edge, and the second wing defines a peripheral edge. A plurality of attachment loops are positioned along the upper edge of each of the first cup and second cup. A plurality of wing loops positioned along a peripheral edge of the first and second wing. A first shoulder strap is configured to detachably connect to the plurality of attachment loops or the plurality of wing loops and a second shoulder strap is configured detachably connect to the plurality of attachment loops or the plurality of wing loops.

19 Claims, 8 Drawing Sheets

ADJUSTABLE BRASSIERE

CROSS REFERENCE TO RELATED APPLICATION

This Application claims priority to and the benefit of United States Provisional Patent Application No. 63/480,854, titled "ADJUSTABLE BRASSIERE," and filed on Jan. 20, 2023, the disclosure of which is incorporated herein by reference in its entirety for all purposes.

FIELD

The present disclosure generally relates to adjustable and versatile brassieres.

BACKGROUND

The statements in this section merely provide background information related to the present disclosure and may not constitute prior art.

Brassieres or bras are common accessories generally worn to support breasts. A person may accumulate many bras during their lifetime each with different colors, styles, comfort, and/or purposes.

Proper support and sizing of a bra is important to the comfort of the wearer. Ill-fitting bras can contribute to chafing, backpain, or painful undulations during activity. Bras are often designed for specific activities such as sports bras or strapless bras and are typically fixed in their configurations.

Bras are sold by cup-size, which is often the key sizing metric a consumer can consider. However, each manufacturer's cup size varies between different brands, and the determination of one's cup size is not intuitive. Measurements to determine cup size are usually done at a retailer and due to differences in measurements, one can find that their cup-size is different depending on which person is conducting the sizing.

Unlike other garments, the supportive design of bras tends to make them rigid and stiff. If a bra no longer fits correctly, it will be uncomfortable to wear which may lead to the purchase an entirely new garment. A need remains for an adjustable, customizable, and versatile bra that address many of the shortcomings of what exists today.

SUMMARY

In an aspect of the present disclosure, an adjustable brassiere undergarment is provided that includes: (a) a first cup defining an upper edge and a second cup defining an upper edge; (b) a first wing extending laterally away from the first cup and a second wing extending laterally away from the second cup, the first wing defining a peripheral edge and the second wing defining a peripheral edge; (c) a plurality of attachment loops positioned along the upper edge of each of the first cup and second cup; (d) a plurality of wing loops positioned along a peripheral edge of each of the first and second wing; (e) a first shoulder strap configured to detachably connect to the plurality of attachment loops or the plurality of wing loops; and (f) a second shoulder strap configured detachably connect to the plurality of attachment loops or the plurality of wing loops. The first and second cups can be connected via a front band and each of the first and second cup can include a concealed underwire element provided within a lower portion of each of the first and second cups and a concealed underwire element provided along the peripheral edge of each wing. In an example, the concealed underwires are made from metal and plastic and configured to provide structural support to the first and second cups. In a further example, the first and second cup and the front band are made of like fabric selected from the group consisting of woven fabric, tricot fabric, foam, cotton, silk, polyester, microfiber, LYCRA spandex, nylon, spandex, lace, satin, and combinations thereof.

In yet another example, the adjustable brassiere undergarment includes a strap fastener positioned on an end of each of the first and second shoulder straps and a wing fastener positioned on an opposite end of each of the first and second shoulder straps. The strap fastener and the wing fastener are configured to detachably connect to an attachment loop or a wing loop. The strap fastener and wing fastener can be selected from the group consisting of a double hook fastener, a clasp, a clamp, and combinations thereof. In another aspect of the present disclosure, the strap fastener and the wing fastener are configured to allow for manual length adjustment to accommodate different sizes, shapes, and desired fits and to provide structural support to the first and second cups. In a further aspect, a strap adjustment feature is provided on each of the first shoulder strap and second shoulder strap. The strap adjustment feature is configured to allow for length adjustment of each of the first and second shoulder strap.

In still a further example, the adjustable undergarment brassiere of the present disclosure includes a plurality of attachment loops integrally formed with the upper edge of the first and second cups and extend evenly with respect to each other along the upper edge. In an aspect of the present disclosure, the plurality of attachment loops may include two to four loops arranged side by side evenly along the upper edge. The plurality of wing loops can be integrally formed with the peripheral edge of the first and second wings and are arranged evenly with respect to each other along the peripheral edge. In another aspect of the present disclosure, the plurality of wing loops include two to four loops arranged evenly along the peripheral edge.

In an even further example, the first and second shoulder straps are connected in a first backless configuration wherein the first should strap connects to an attachment loop of the first cup and to a wing loop of the first wing and the second shoulder strap connects to an attachment loop of the second cup and a wing loop of the second wing, and the first and second shoulder straps are configured to connect around the arms of the user, respectively with no shoulder strap connection around a back of a user.

In still another example, the first and second shoulder straps are connected in a halter top configuration where the first shoulder strap connects to an attachment loop of the first cup and to an attachment loop of the second cup, the first shoulder strap is configured to connect around a neck of a user, and the second shoulder strap connects to a wing loop of the first wing and a wing loop of the second wing. The second shoulder strap is configured to connect around a back of a user.

In yet a further example, the first and second shoulder straps are connected in a crisscross configuration where the first shoulder strap connects to an attachment loop of the first cup and to a wing loop of the second wing, and the second shoulder strap connects to an attachment loop of the second cup and to a wing loop of the first wing, where the first shoulder strap and the second shoulder strap are configured to intersect around a back of a user forming a crisscross pattern.

In even yet still another example, the first and second shoulder straps are connected in a double-strap strapless-shoulder configuration where the first shoulder strap connects to an upper wing loop of the first wing and to an upper wing loop of the second wing, and the second shoulder strap connects to a lower wing loop of the second cup and to a lower wing loop of the first wing, where the first shoulder strap and the second shoulder strap are configured to connect horizontally around a back of a user.

In even yet still a further example, the first shoulder strap is connected in a single-strap strapless-shoulder configuration where the first shoulder strap connects to a wing loop of the first wing and to a wing loop of the second wing, and the second shoulder strap is absent, and where the first shoulder strap is configured to connect horizontally around a back of a user.

The present disclosure provides for, an adjustable brassiere undergarment including: (a) a first cup defining an upper edge and a second cup defining an upper edge, the first cup and second cup are connected by a front band; (b) a first wing extending laterally away from the first cup and a second wing extending laterally away from the second cup, the first wing defining a peripheral edge and the second wing defining a peripheral edge; (c) two to four attachment loops arranged side by side evenly along the upper edge of each of the first cup and second cup; (d) two to four wing loops arranged evenly with respect to each other along each peripheral edge of the first and second wings; (e) a first adjustable shoulder strap configured to detachably connect to the two to four of attachment loops or the two to four wing loops; and (f) a second adjustable shoulder strap configured to detachably connect to the two to four attachment loops or the two to four wing loops. In an example, a strap fastener is positioned on an end of each of the first and second shoulder straps and a wing fastener is positioned on an opposite end of each of the first and second shoulder straps, where the strap fastener and the wing fastener are configured to detachably connect to an attachment loop or a wing loop. In another example, the strap fastener and wing fastener are configured to allow for manual length adjustment to accommodate different sizes, shapes, and desired fits and to provide structural support to the first and second cups, and where the strap fastener and wing fastener are selected from the group consisting of a double hook fastener, a clasp, a clamp, and combinations thereof.

Further areas of applicability will become apparent from the description provided herein. It should be understood that the description and specific examples are intended for purposes of illustration only and are not intended to limit the scope of the present disclosure.

BRIEF DESCRIPTION OF DRAWINGS

In order that the disclosure may be well understood, there will now be described various forms thereof, given by way of example, reference being made to the accompanying drawings in which.

Figure 1:
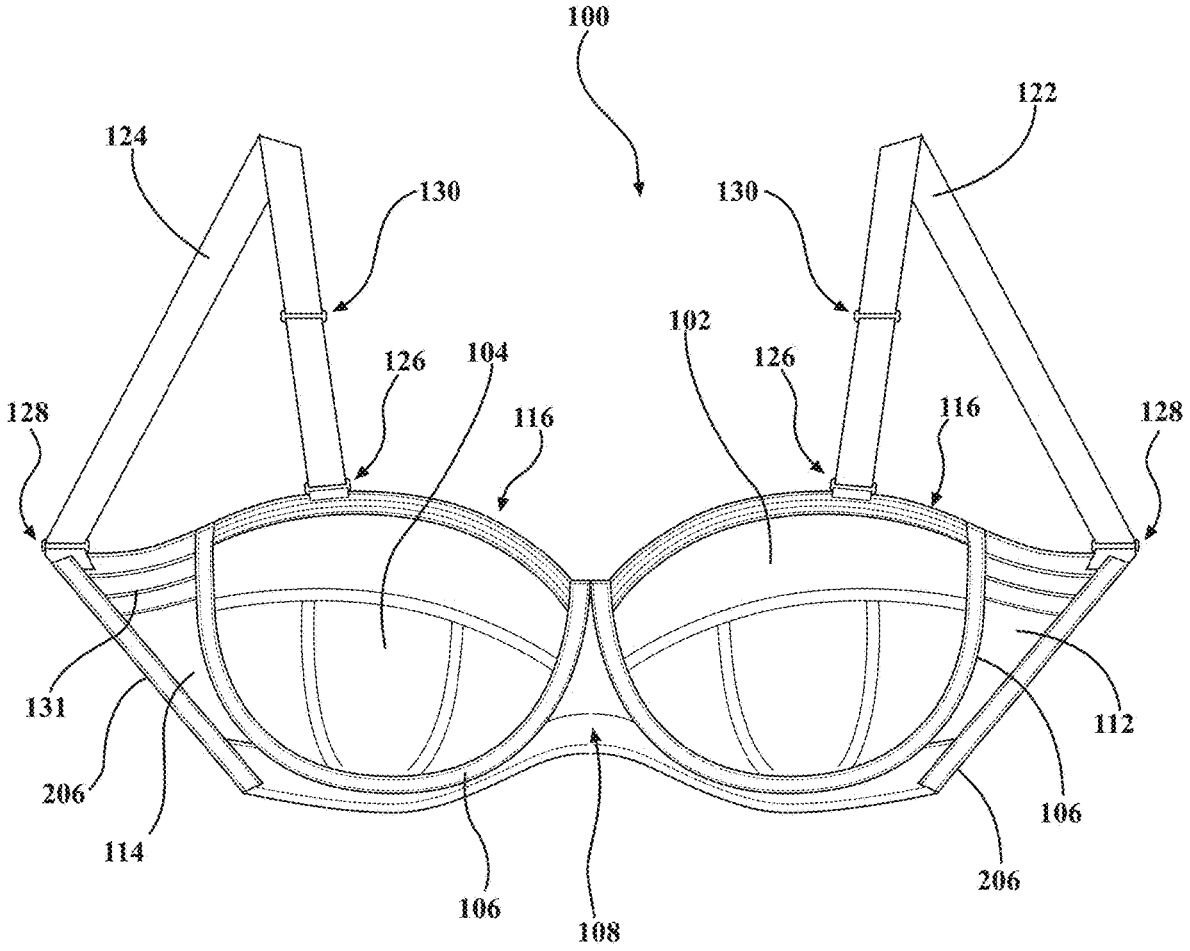
FIG. 1 is a rear side view of an adjustable bra according to the present disclosure.
Figure 2:
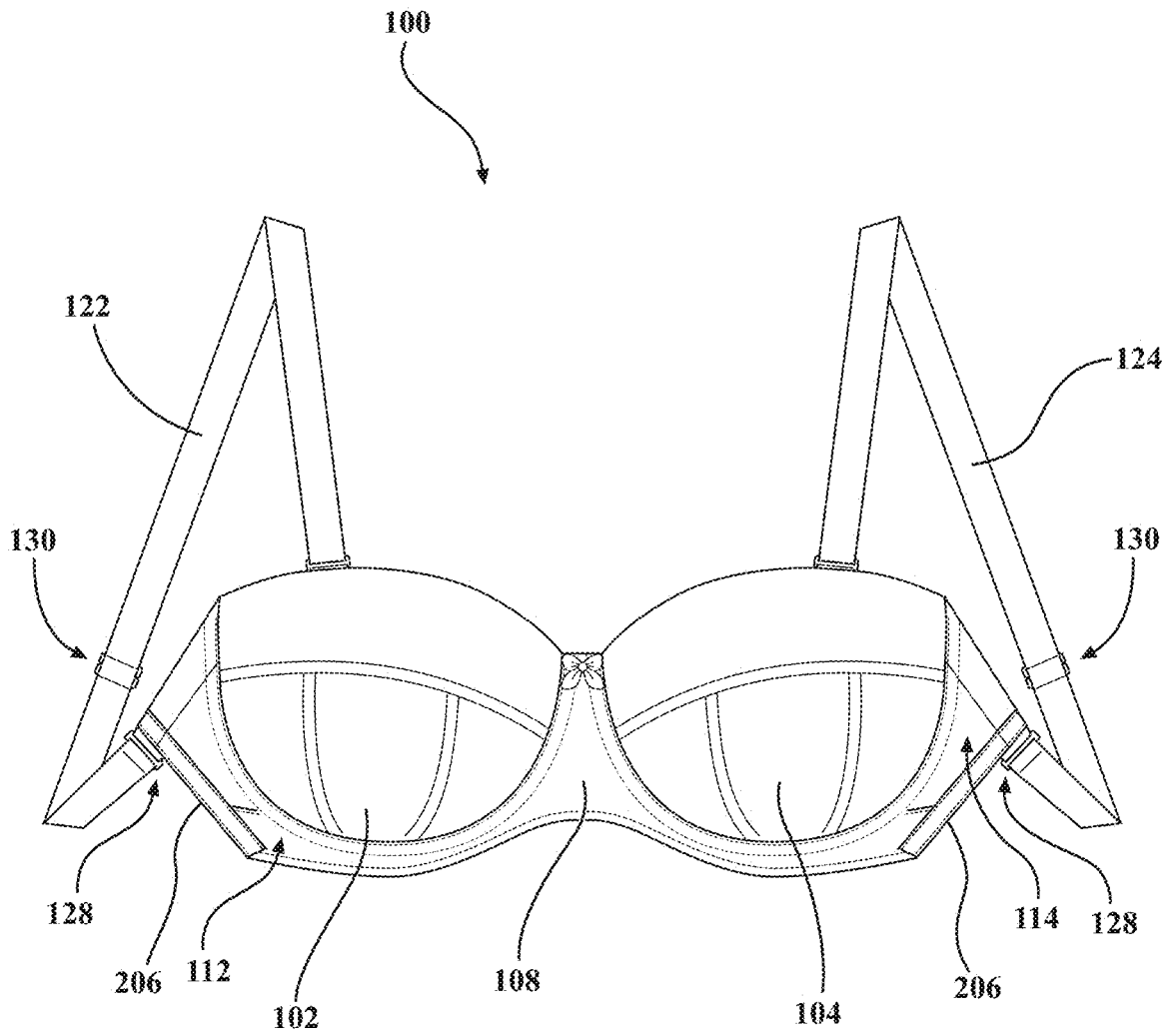
FIG. 2 is a front side view of the adjustable bra of FIG. 1.
Figure 3:
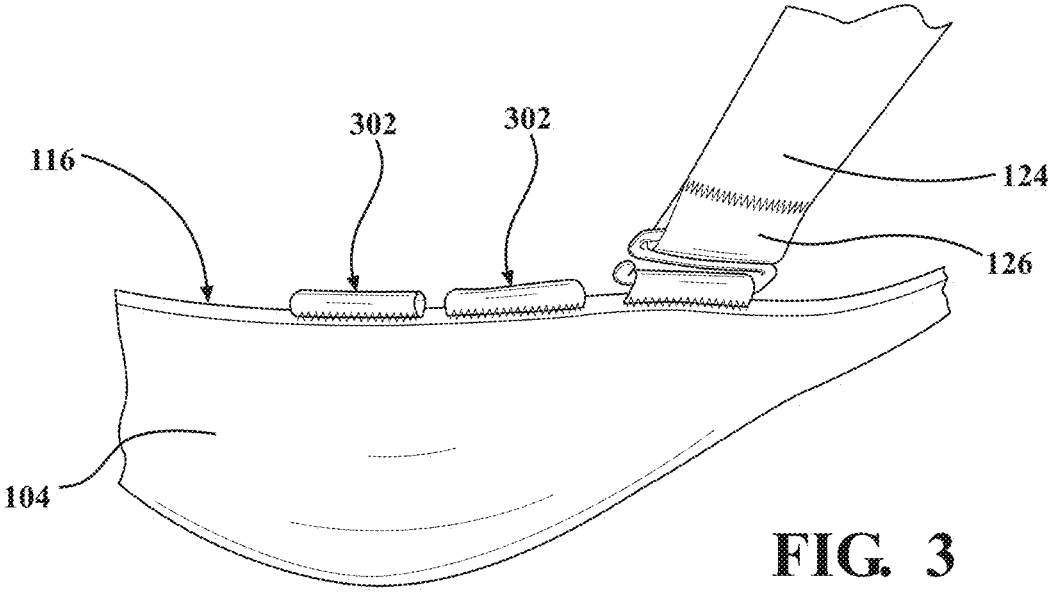
FIG. 3 is a magnified view of attachment loops provided on a wing portion of an adjustable bra of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure provides for an improved, adjustable, customizable, and versatile, "brassiere" or "bra" in which the shape and position of one or more shoulder straps can be adjusted. The adjustability allows for versatility, customization, and immediate modification to accommodate a range of styles, fits, and preferences for different configurations.

Referring to FIGS. 1-14, the present disclosure provides for an adjustable bra 100 having a first cup 102 and a second cup 104. First and second cups 102 and 104 can be made of any suitably material, including from fabric material, come in varied sizes and are configured to support the breasts of a wearer. An underwire 106 is provided on a lower portion of each cup 102 and 104 and typically concealed by like fabric to the cups 102/104 and configured to provide structural support respectively for each cup 102/104. In an example, underwire 106 is a rigid or semi-rigid material such as metal or plastic or a combination thereof and can be made to be flexible while providing sufficient structural support.

In an example, a front band 108 is provided connecting first cup 102 and second cup 104 together. Cups 102 and 104 and front band 108 can be made of woven or tricot fabric, foam, cotton, silk, polyester, microfiber, LYCRA spandex, nylon, spandex, lace, satin, or the like.

Adjustable bra 100 further includes a first wing 112 and a second wing 114. First wing 112 extends from a lateral side of first cup 102. Likewise, second wing 114 extends from a lateral side of second cup 104, opposite from first wing 112. An underwire 106 is provided along a peripheral edge 206 of each wing 112/114 and typically concealed by like fabric to the cups 102/104 and configured to provide structural support along a side of a wearer's body. In an example, underwire 106 is a rigid or semi-rigid material such as metal or plastic or a combination thereof and can be made to be flexible while providing sufficient structural support.

In an example, adjustable bra 100 includes a first shoulder strap 122 and a second shoulder strap 124. The first and second shoulder straps 122/124 can be flexible and adjustable. The shoulder straps 122/124 can attach to an upper edge 116 of first and second cups 102 and 104, respectively. A detachable shoulder strap fastener 126 is positioned at an end of the first and second should straps 122/124 and configured to detachably engage/connect at or near the upper edge 116 of first and second cup 102/104, respectively. In another example, the position of the strap fasteners 126 along the upper edge 116 can be adjusted. In use, the position of the strap fasteners 126 should be configured to ensure sufficient lifting and structural support to the cups 102/104 during use by shoulder straps 122/124.

Wing fasteners 128 are provided on each shoulder strap 122/124 at opposite ends from strap fasteners 126. Wing fasteners 128 are configured to engage each of first and second wings 112/114. In an example, shoulder fastener 126 and wing fastener 128 include a double hook fastener, a clasp, a clamp, and/or the like. Each shoulder fastener 126 and wing fastener 128 should be configured to allow for manual length adjustment to accommodate different sizes, shapes, and desired fit through a strap adjustment feature 130 provided along each shoulder strap. Strap adjustment feature 130 is configured to shorten or lengthen an effective length of each shoulder strap 122/124.

Figure 4:
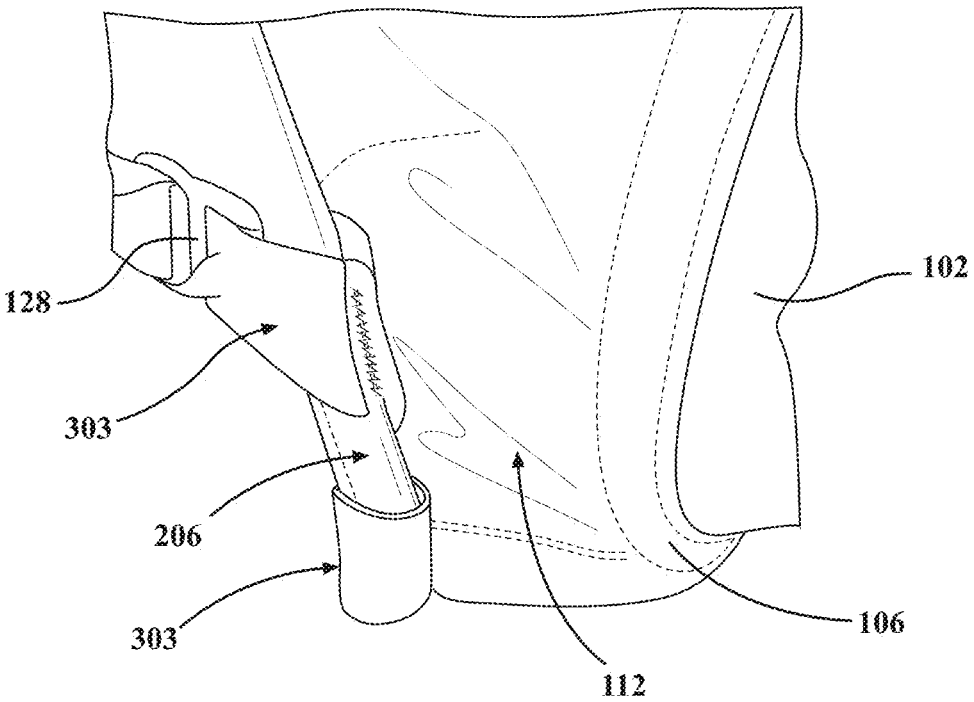
FIG. 4 is a magnified view of attachment loops provided on an upper side of a cup of an adjustable bra of the present disclosure.
Figure 5:
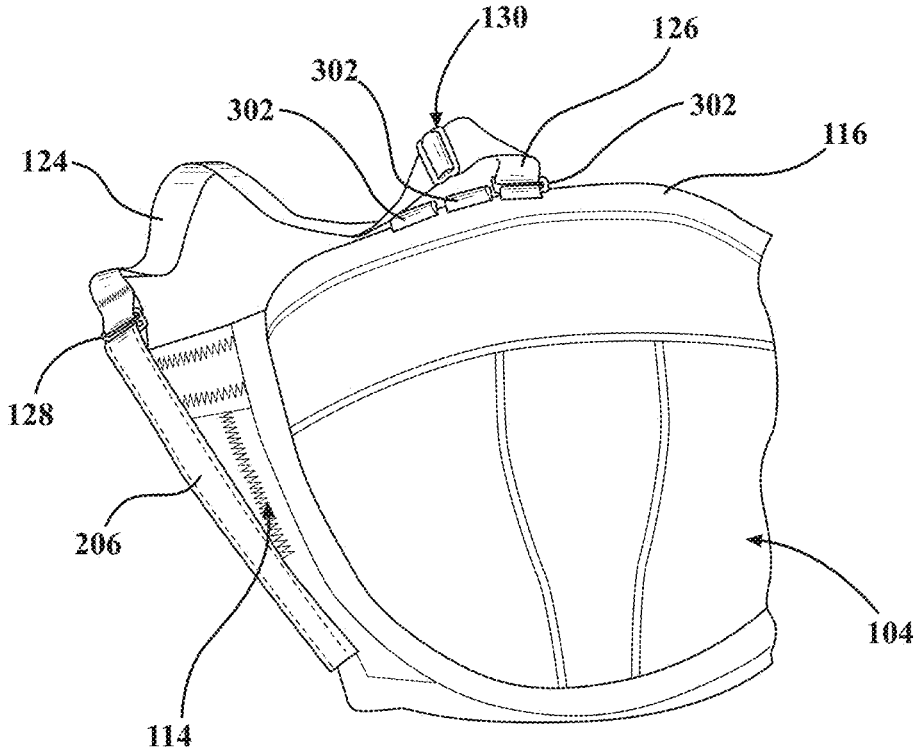
FIG. 5 illustrates an interior side of an adjustable bra of the present disclosure in a backless configuration.
Figure 6:
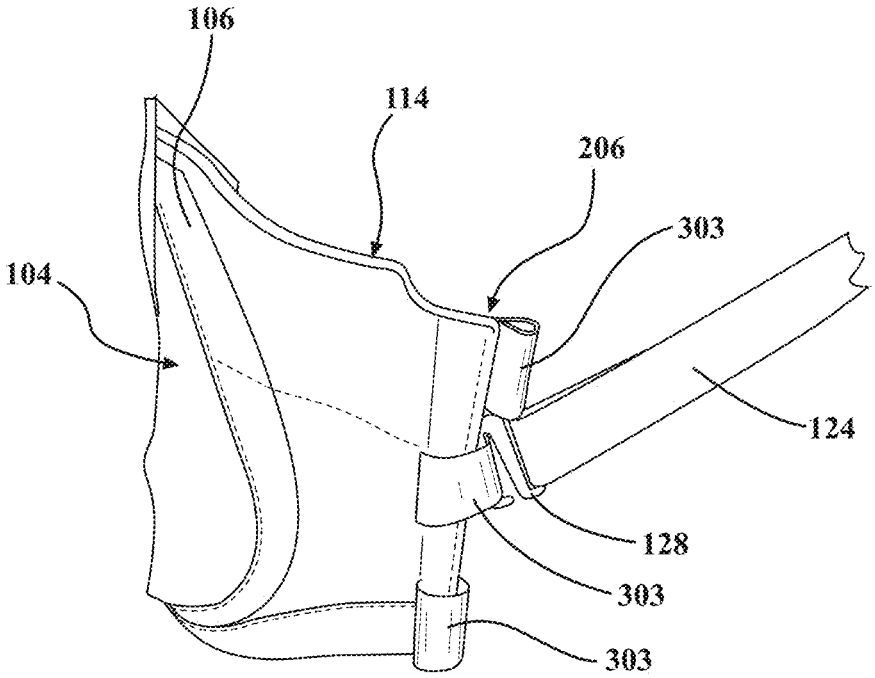
FIG. 6 illustrates a magnified side view of an adjustable bra of the present disclosure with a wing band and a strap connection in a backless configuration.

In an example, adjustable bra 100 includes one or more attachment loops 302 arranged on the upper edge 116. Multiple attachment loops 302 can be positioned along a length of the upper edge 116 arranged in a side-by-side configuration. Each attachment loop 302 defines an opening for receiving and detachably securing a strap fastener 126 or wing fastener 128 therethrough. Wing loops 303 are provided along a peripheral edge 206 of wings 112/114, each defining an opening configured to receive and detachably secure strap fastener 126 or wing fastener 128. A plurality of wing loops 303 can be provided, as shown in FIG. 4, configured for a variety of strap connections and adjustability. Wing loops 303 are arranged along the peripheral edge 206 while attachment loops 302 are arranged along the upper edge 116.

In an example, adjustable bra 100 includes a plurality of attachment loops 302 In one example, two (2), three (3), or four (4) attachment loops 302 are provided and arranged evenly spaced with respect to each other along upper edge 116 of each first and second cups 102/104. Adjustable bra 100 can further include a plurality of wing loops 303. In this example, two (2), three (3), or four (4) wing loops 303 are arranged along the peripheral edge 206 of each first and second wing 112, 114. The evenly spaced attachment loops 302 and wing loops 303 provide a user with customization and adjustability for sizing and style adjustments, which allows for a variety of strap configurations.

Figure 7:
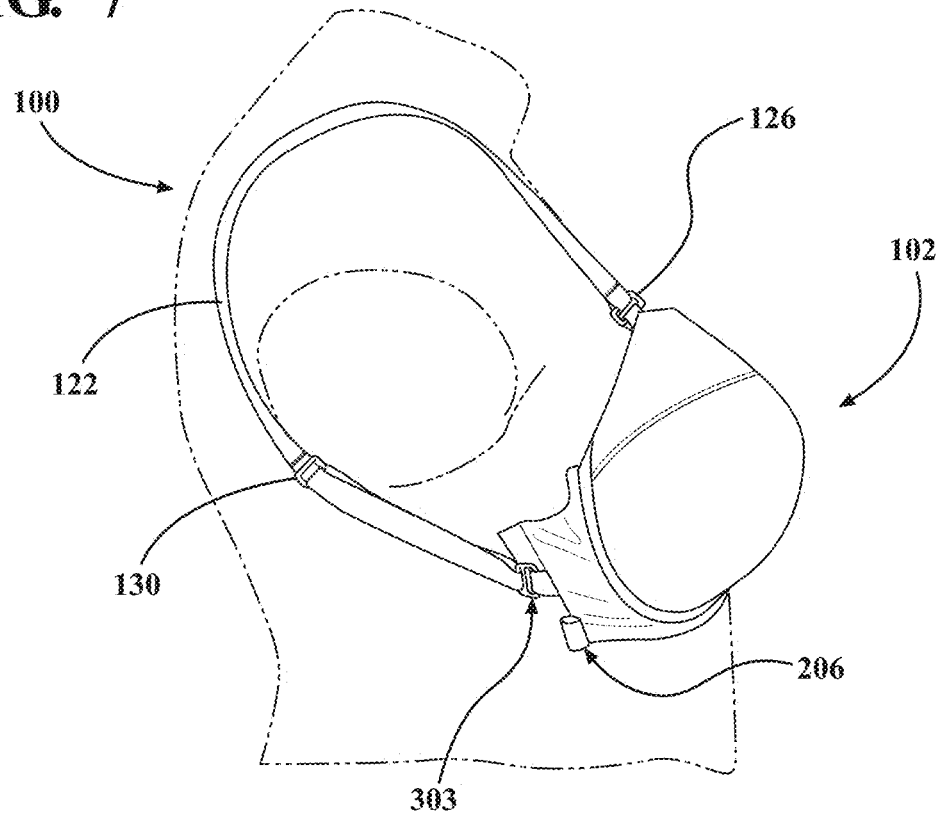
FIG. 7 illustrates a side view of a backless configuration of an adjustable bra of the present disclosure positioned on a mannequin.
Figure 8:
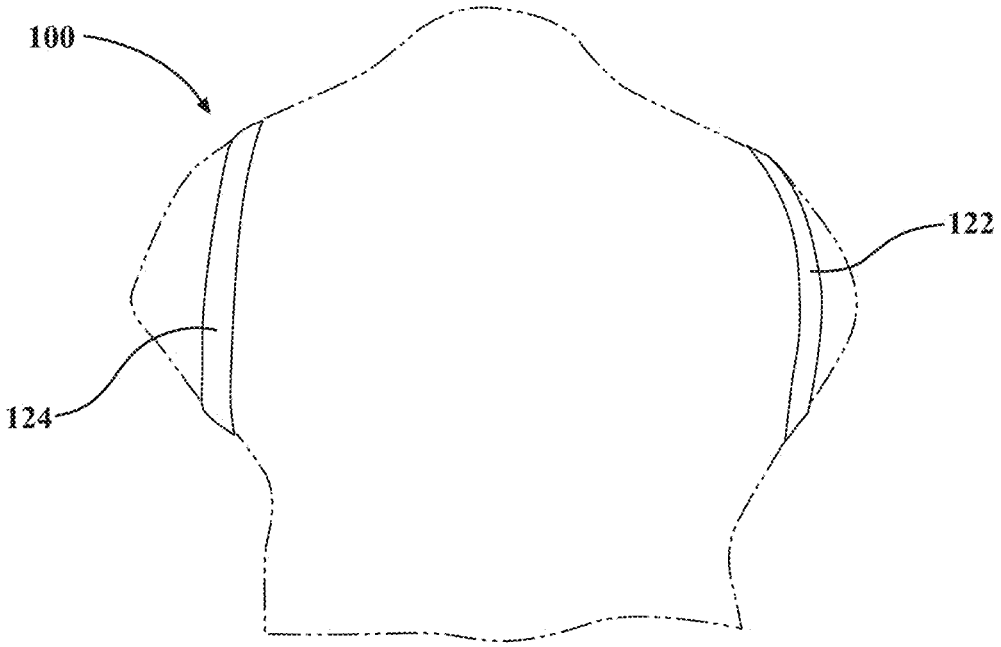
FIG. 8 illustrates a back view of the backless configuration of FIG. 7 positioned on the mannequin.

Referring to FIGS. 7-8, a first "backless" configuration is shown. The term "backless" is generally used to describe a configuration where a bra is not readily visible when wearing a backless dress. Adjustable bra 100, in this first over-the-shoulder configuration, includes first and second shoulder straps 122 and 124. First shoulder strap 122 connects to first cup 102 by shoulder fastener 126 engaging an attachment loop 302 on an upper edge 116. First shoulder strap 122 connects to the first wing 112 by wing fastener 128 engaging a wing loop 303 provided along the peripheral edge 206. Likewise, second shoulder strap 124 connects to the second cup 104 by shoulder fastener 126 engaging an attachment loop 303 on an upper edge 116. Second shoulder strap 124 connects to second wing 114 by wing fastener 128 engaging a wing loop 303 provided along the peripheral edge 206. The first and second shoulder straps 122 and 124 extend over and around a corresponding shoulder of a wearer (in this example, a mannequin for illustrative purposes). Each shoulder strap 122/124 passes underneath a corresponding arm. This allows for support without connecting the straps across a back of a wearer and thus leaves the back open without showing a bra strap when wearing a backless dress.

In an example, silicone tape 130 can be provided. Silicone tape, which can be transparent, provides additional support by increasing friction between first and second cups 102/104 and the skin of a wearer. The positioning of first and second shoulder straps 122/124 along with silicone tape should be effective to prevent adjustable bra 100 from falling forward. This first over-the-shoulder backless configuration provides desired support while allowing the bra to be concealed from view when wearing a backless dress or other backless garment (i.e., a shirt, blouse, and the like). This increases the availability of different outfits, styles, dresses, and variety in the overall appearance.

Figure 9:
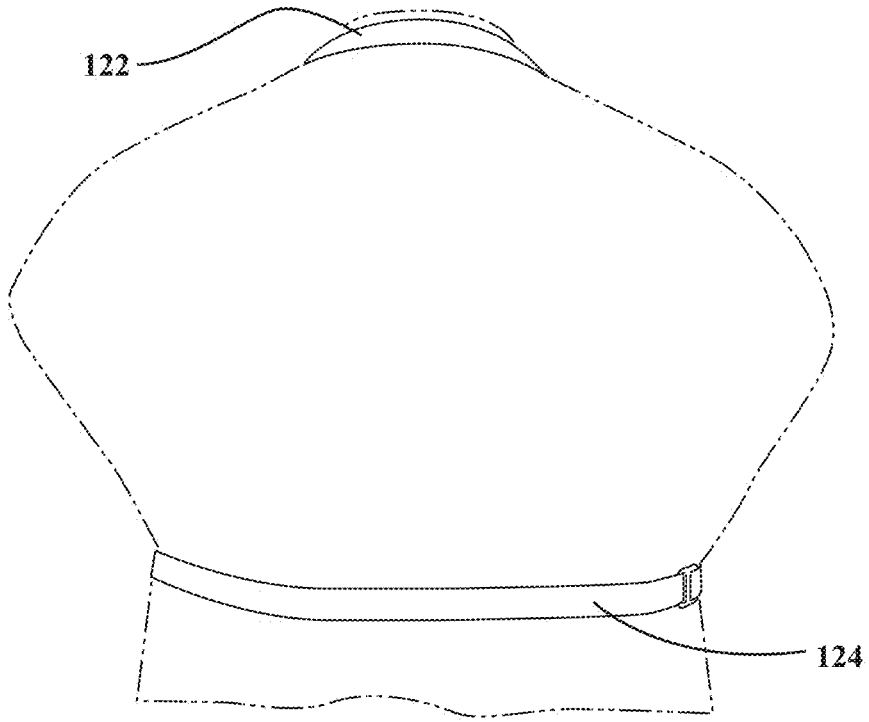
FIG. 9 illustrates a back view of an adjustable bra of the present disclosure in a halter top configuration positioned on a mannequin.

Referring to FIG. 9, in another example of a backless halter-top configuration, adjustable bra 100 is arranged with the shoulder strap 122 extending from attachment loop 302 of cup 102, around and behind the user's neck and then connected to an attachment loop 302 of cup 104. The shoulder strap 124 is attached at the wing loops 303 of each wing 112/114 peripheral edge 206 and extends across the back. In this configuration, the shoulder strap 122 wraps posteriorly around the neck of a wearer, while second shoulder strap 124 wraps horizontally across the back of a wearer.

Figure 10:
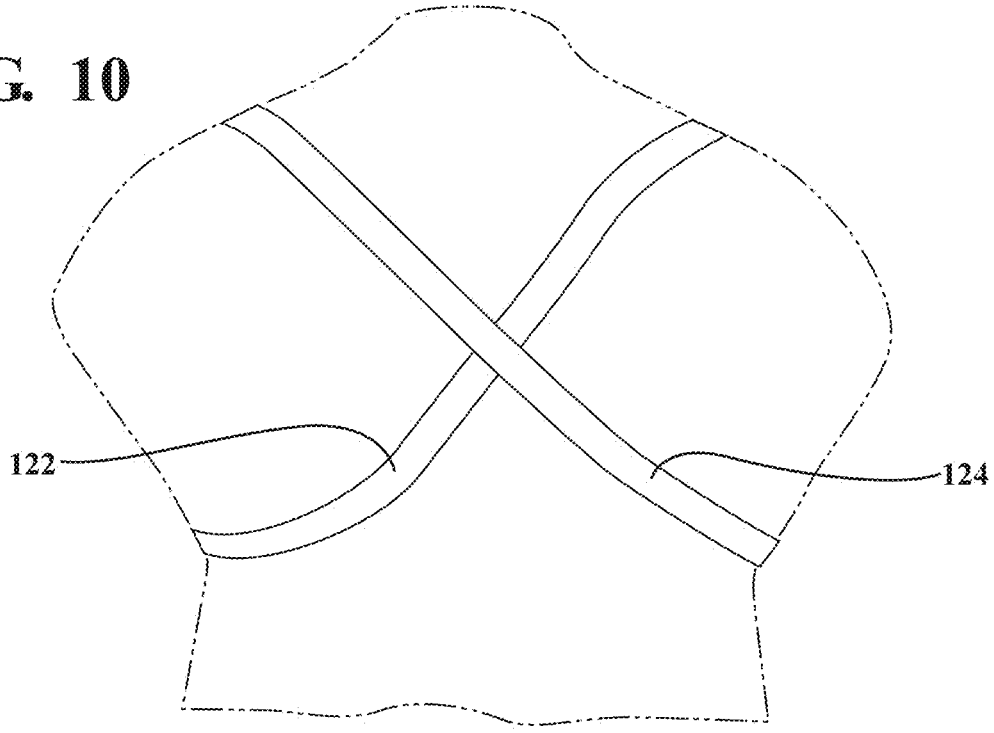
FIG. 10 illustrates a back view of an adjustable bra of the present disclosure in a crisscross configuration positioned on a mannequin.

Referring to FIG. 10, a crisscross pattern example is shown. In this example, shoulder strap 122 is attached to one of the attachment loops 302 of first cup 102 and then over the shoulder and across the back and under the opposite arm connecting to a wing loop 303 of the second cup 104. Shoulder strap 124 is attached to one of the attachment loops 302 of second cup 104 and then over the shoulder and across the back and under the opposite arm connecting to a wing loop 303 of the first cup 102. This configuration provides a desired crisscross appearance on the back.

Figure 11:
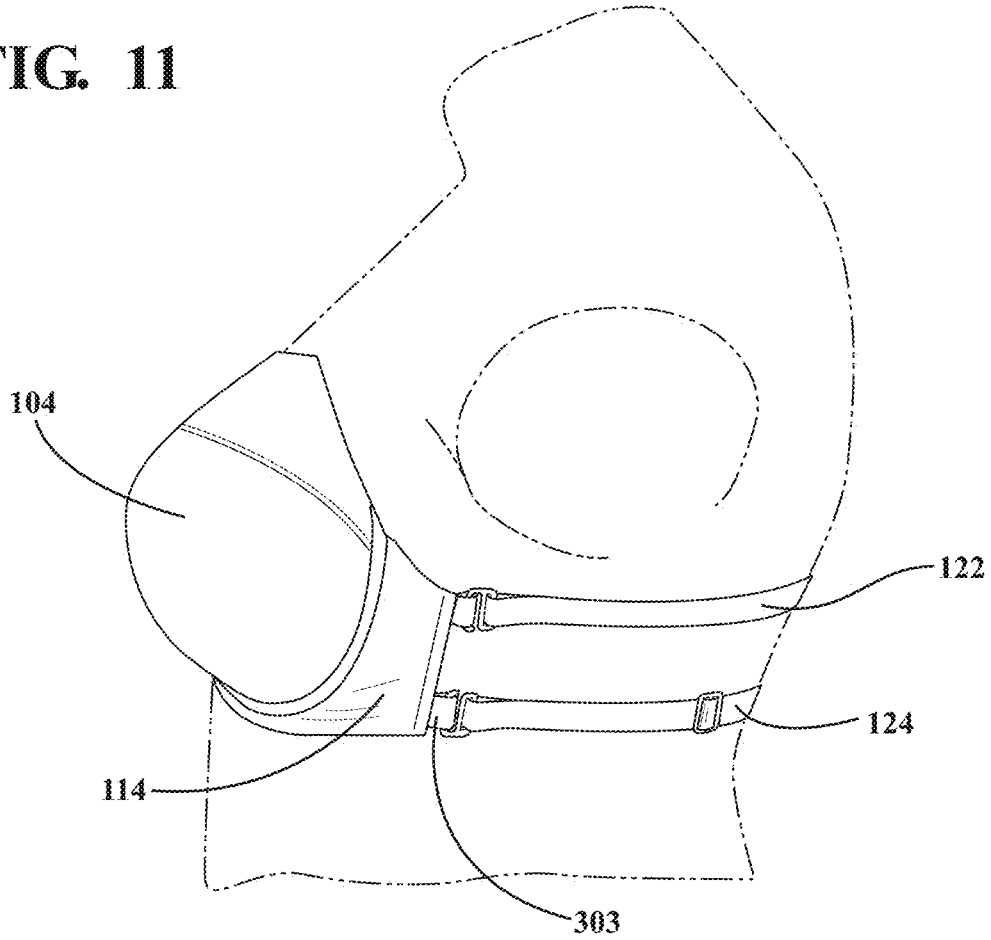
FIG. 11 illustrates a side view of an adjustable bra of the present disclosure in a double strap configuration positioned on a mannequin.
Figure 12:
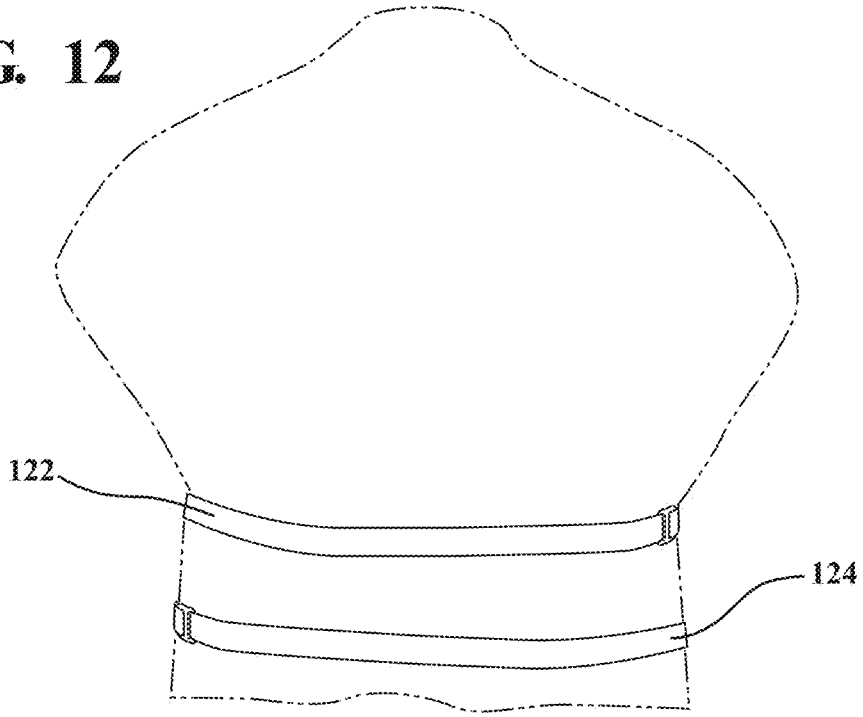
FIG. 12 illustrates a back view of the adjustable bra of FIG. 11.

Referring to FIGS. 11-12, in an example, adjustable bra 100 is arranged in a double-strap strapless-shoulder configuration utilizing both first and second shoulder straps 122 and 124 horizontally across the back. In this configuration, first shoulder strap 122 is connected an upper wing loop 303 of first wing 112 of first cup 102 and connected to an upper wing loop 303 located on second wing 112 of second cup 104 across the back. Second shoulder strap 124 is connected a lower wing loop 303 located on first wing 112 of first cup 102 and connected to a lower wing loop 303 located on second wing 114 of second cup 104. In this configuration, the attachment loops 302 are not connected to the shoulder straps 122/124.

Figure 13:
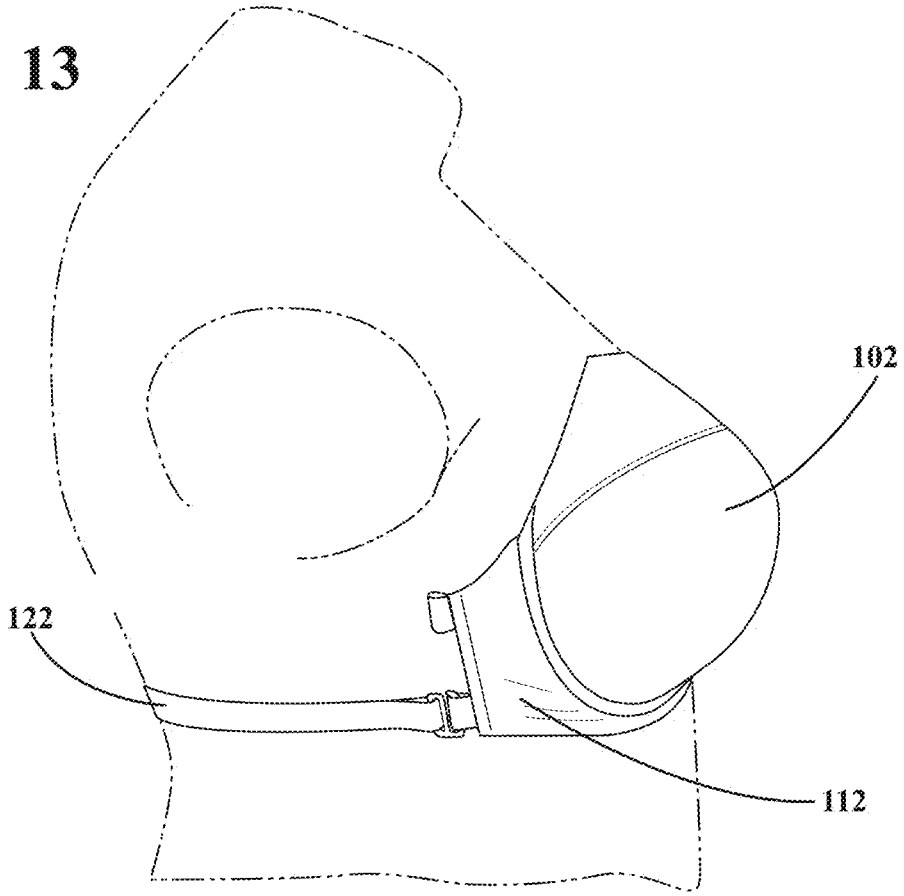
FIG. 13 illustrates of a side view of an adjustable bra of the present disclosure in a single strap configuration positioned on a mannequin.
Figure 14:
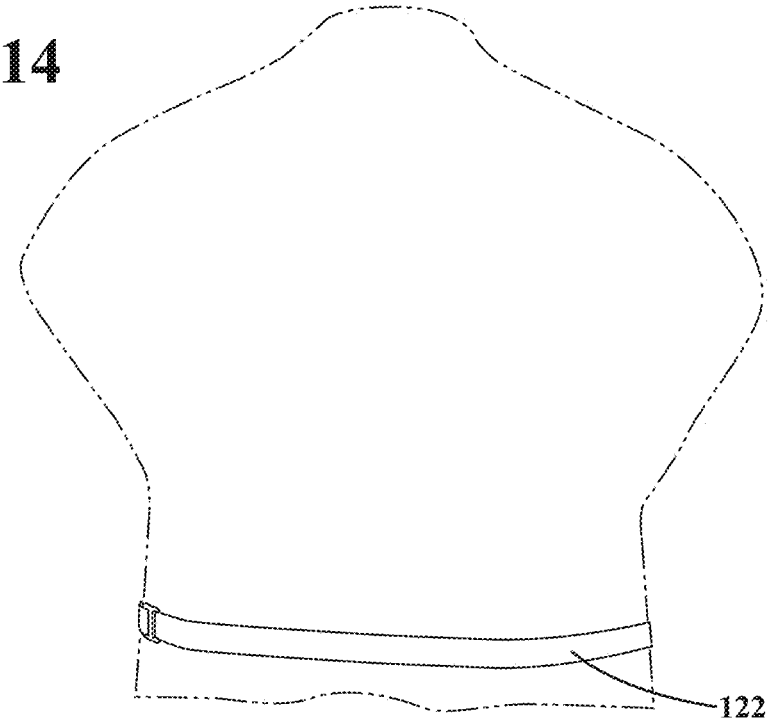
FIG. 14 illustrates a back view of the adjustable bra of FIG. 13.

Referring to FIGS. 13-14, in an example, adjustable bra 100 is arranged in a single-strap strapless-shoulder configuration using a single shoulder strap 122/124. The single shoulder strap (122 or 124) is connected to one of the wing loops 303 of first wing 112 of first cup 102 and then connected across the back to one of the wing loops 303 of the second wing 114 of second cup 104. In this configuration, the other shoulder strap (122 or 124) is not used.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An adjustable brassiere undergarment comprising:

(a) a first cup defining an upper edge and a second cup defining an upper edge;

(b) a first wing extending laterally away from the first cup and a second wing extending laterally away from the second cup, the first wing defining a peripheral edge and the second wing defining a peripheral edge;

(c) a plurality of attachment loops positioned along the upper edge of each of the first cup and second cup;

(d) a plurality of wing loops positioned along a peripheral edge of each of the first and second wing;

(e) a first shoulder strap configured to detachably connect to the plurality of attachment loops or the plurality of wing loops; and (f) a second shoulder strap configured detachably connect to the plurality of attachment loops or the plurality of wing loops;

wherein the first and second cups are connected via a front band and each of the first and second cup includes a concealed underwire element provided within a lower portion of each of the first and second cups and a concealed underwire element provided along the peripheral edge of each wing.

2. The adjustable undergarment brassiere of claim 1, wherein the concealed underwires are made from metal and plastic and configured to provide structural support to the first and second cups.

3. The adjustable undergarment brassiere of claim 1, wherein the first and second cup and the front band are made of like fabric selected from the group consisting of woven fabric, tricot fabric, foam, cotton, silk, polyester, microfiber, nylon, spandex, lace, satin, and combinations thereof.

4. The adjustable undergarment brassiere of claim 1, further comprising a strap fastener positioned on an end of each of the first and second shoulder straps and a wing fastener positioned on an opposite end of each of the first and second shoulder straps, wherein the strap fastener and the wing fastener are configured to detachably connect to an attachment loop or a wing loop.

5. The adjustable undergarment brassiere of claim 4, wherein the strap fastener and wing fastener are selected from the group consisting of a double hook fastener, a clasp, a clamp, and combinations thereof.

6. The adjustable undergarment brassiere of claim 4, wherein the strap fastener and the wing fastener are configured to allow for manual length adjustment to accommodate different sizes, shapes, and desired fits and to provide structural support to the first and second cups.

7. The adjustable undergarment brassiere of claim 1, further comprising a strap adjustment feature provided on each of the first shoulder strap and second shoulder strap, wherein the strap adjustment feature is configured to allow for length adjustment of each of the first and second shoulder strap.

8. The adjustable undergarment brassiere of claim 1, wherein the plurality of attachment loops are integrally formed with the upper edge of the first and second cups and extend evenly with respect to each other along the upper edge.

9. The adjustable undergarment brassiere of claim 1, wherein the plurality of attachment loops include two to four loops arranged side by side evenly along the upper edge.

10. The adjustable undergarment brassiere of claim 1, wherein the plurality of wing loops are integrally formed with the peripheral edge of the first and second wings and are arranged evenly with respect to each other along the peripheral edge.

11. The adjustable undergarment brassiere of claim 1, wherein the plurality of wing loops include two to four loops arranged evenly along the peripheral edge.

12. The adjustable undergarment brassiere of claim 1, wherein the first and second shoulder straps are connected in a first backless configuration wherein the first should strap connects to an attachment loop of the first cup and to a wing loop of the first wing and the second shoulder strap connects to an attachment loop of the second cup and a wing loop of the second wing, wherein the first and second shoulder straps are configured to connect around the arms of the user, respectively with no shoulder strap connection around a back of a user.

13. The adjustable undergarment brassiere of claim 1, wherein the first and second shoulder straps are connected in a halter top configuration wherein the first shoulder strap connects to an attachment loop of the first cup and to an attachment loop of the second cup, the first shoulder strap is configured to connect around a neck of a user, and the second shoulder strap connects to a wing loop of the first wing and a wing loop of the second wing, the second shoulder strap is configured to connect around a back of a user.

14. The adjustable undergarment brassiere of claim 1, wherein the first and second shoulder straps are connected in a crisscross configuration wherein the first shoulder strap connects to an attachment loop of the first cup and to a wing loop of the second wing, and the second shoulder strap connects to an attachment loop of the second cup and to a wing loop of the first wing, wherein the first shoulder strap and the second shoulder strap are configured to intersect around a back of a user forming a crisscross pattern.

15. The adjustable undergarment brassiere of claim 1, wherein the first and second shoulder straps are connected in a double-strap strapless-shoulder configuration wherein the first shoulder strap connects to an upper wing loop of the first wing and to an upper wing loop of the second wing, and the second shoulder strap connects to a lower wing loop of the second cup and to a lower wing loop of the first wing, wherein the first shoulder strap and the second shoulder strap are configured to connect horizontally around a back of a user.

16. The adjustable undergarment brassiere of claim 1, wherein the first shoulder strap is connected in a single-strap strapless-shoulder configuration wherein the first shoulder strap connects to a wing loop of the first wing and to a wing loop of the second wing, and the second shoulder strap is absent, and wherein the first shoulder strap is configured to connect horizontally around a back of a user.

17. An adjustable brassiere undergarment comprising:

(a) a first cup defining an upper edge and a second cup defining an upper edge, the first cup and second cup are connected by a front band;

(b) a first wing extending laterally away from the first cup and a second wing extending laterally away from the second cup, the first wing defining a peripheral edge and the second wing defining a peripheral edge;

(c) two to four attachment loops arranged side by side evenly along the upper edge of each of the first cup and second cup;

(d) two to four wing loops arranged evenly with respect to each other along each peripheral edge of the first and second wings;

(e) a first adjustable shoulder strap configured to detachably connect to the two to four of attachment loops or the two to four wing loops; and (f) a second adjustable shoulder strap configured to detachably connect to the two to four attachment loops or the two to four wing loops;

wherein the first and second cups are connected via a front band and each of the first and second cup includes a concealed underwire element provided within a lower portion of each of the first and second cups and a concealed underwire element provided along the peripheral edge of each wing.

18. The adjustable undergarment brassiere of claim 17, further comprising a strap fastener positioned on an end of each of the first and second shoulder straps and a wing fastener positioned on an opposite end of each of the first and second shoulder straps, wherein the strap fastener and the wing fastener are configured to detachably connect to an attachment loop or a wing loop.

19. The adjustable undergarment brassiere of claim 18, wherein the strap fastener and wing fastener are configured to allow for manual length adjustment to accommodate different sizes, shapes, and desired fits and to provide structural support to the first and second cups, and wherein the strap fastener and wing fastener are selected from the group consisting of a double hook fastener, a clasp, a clamp, and combinations thereof.

* * * * *